US009359662B2

(12) United States Patent
Gierl-Mayer et al.

(10) Patent No.: US 9,359,662 B2
(45) Date of Patent: Jun. 7, 2016

(54) IRON-CARBON MASTER ALLOY

(75) Inventors: Christian Gierl-Mayer, Vienna (AT); Herbert Danninger, Vienna (AT); Yousef Hemmatpour, Tehran (IR)

(73) Assignee: TECHNISCHE UNIVERSITÄT WIEN, Vienna (AT)

( * ) Notice: Subject to any disclaimer, the term of this patent is extended or adjusted under 35 U.S.C. 154(b) by 694 days.

(21) Appl. No.: 13/140,811

(22) PCT Filed: Dec. 17, 2009

(86) PCT No.: PCT/EP2009/067445
§ 371 (c)(1),
(2), (4) Date: Jun. 17, 2011

(87) PCT Pub. No.: WO2010/070065
PCT Pub. Date: Jun. 24, 2010

(65) Prior Publication Data

US 2011/0253264 A1 Oct. 20, 2011

(30) Foreign Application Priority Data

Dec. 19, 2008 (AT) ..... A 1989/2008

(51) Int. Cl.

| | |
|---|---|
| ***C22C 38/08*** | (2006.01) |
| ***C22C 38/04*** | (2006.01) |
| ***C22C 33/02*** | (2006.01) |
| ***C22C 35/00*** | (2006.01) |
| ***C22C 38/42*** | (2006.01) |
| ***C22C 38/44*** | (2006.01) |
| ***C22C 38/56*** | (2006.01) |
| *C22C 38/12* | (2006.01) |
| *C21D 1/18* | (2006.01) |

(52) U.S. Cl.
CPC ..... *C22C 38/04* (2013.01); *C22C 33/0257* (2013.01); *C22C 35/005* (2013.01); *C22C 38/42* (2013.01); *C22C 38/44* (2013.01); *C22C 38/56* (2013.01); *B22F 2998/10* (2013.01); *C21D 1/18* (2013.01)

(58) Field of Classification Search
CPC ..... C22C 38/04; C22C 38/42; C22C 38/44; C22C 38/56
USPC ..... 148/513, 321, 324, 332, 336, 337, 333, 148/334, 320, 335
See application file for complete search history.

(56) References Cited

U.S. PATENT DOCUMENTS

| | | | | |
|---|---|---|---|---|
| 3,368,890 | A | 2/1968 | Schroeder et al. | 419/23 |
| 6,358,298 | B1 | 3/2002 | Gagne et al. | 75/243 |

FOREIGN PATENT DOCUMENTS

| | | |
|---|---|---|
| DE | 19 60 433 | 6/1971 |
| DE | 2456781 | 7/1976 |
| DE | 10 2006 027851 | 12/2007 |
| EP | 0274542 | 7/1987 |
| JP | 62-124256 | 1/1987 |
| JP | 06-228603 | 8/1994 |

OTHER PUBLICATIONS

Machine translation of JP 06228603, 1994.*
English Translation of the International Preliminary Report on Patentability issued in PCT/EP2009/067445, dated Jun. 21, 2011.
International Search Report issued in PCT/EP2009/067445, dated Mar. 30, 2010.

* cited by examiner

*Primary Examiner* — Rebecca Lee
(74) *Attorney, Agent, or Firm* — Norton Rose Fulbright US LLP

(57) ABSTRACT

An iron-carbon master alloy is described, with a C content of 0.3 to 8 wt % and an upper limit of alloying metals Ni<10 wt %, P<4 wt %, Cr<5 wt %, preferably<1 wt %, Mn<5 wt %, preferably<1 wt %, Mo<3 wt %, W<3 wt %, Cu<1 wt %, a particle size of >20 μm and a hardness of <350 HV 0.01, and a method for the manufacture of said master alloy.

13 Claims, No Drawings

IRON-CARBON MASTER ALLOY

This application is a national phase application under 35 U.S.C. §371 of International Application No. PCT/EP2009/067445 filed 17 Dec. 2009, which claims priority to Austrian Application No. A 1989/2008 filed 19 Dec. 2008. The entire text of each of the above-referenced disclosures is specifically incorporated herein by reference without disclaimer.

Iron-based moulded parts produced by powder metallurgy are increasingly used for high mechanical stresses, particularly in car engines and transmissions. Starting from powder mixtures, the parts are pressed axially in pressing tools and are then sintered at temperatures of approximately 1120-1300° C. in the presence of inert gas. In many cases a heat treatment of the blank follows, such as curing, carburising, etc. It is important to achieve maximum relative density, i.e. low residual porosity, as early as the pressing process since the porosity hardly decreases further during sintering of these moulded parts and the mechanical properties are significantly better with greater density, which corresponds to lower porosity.

Alloyed sintered steels with C contents of 0.3 to 0.7% are predominantly used for highly stressed precision parts. Traditionally, the carbon is introduced by mixing in highly pure, fine natural graphite, which dissolves in the iron or steel matrix during sintering. This mixture of metal and graphite powder can be effectively pressed and provides high relative densities during the pressing process. However, the volume requirement of the graphite is obstructive when pressing at very high relative densities (>94%). Graphite, which has a density of only approximately 2.2 gcm-3 compared to 7.86 gcm-3 with iron, takes up a relatively large amount of space in the pressed part; if the graphite dissolves in the iron during sintering, pores will remain at these points. Particularly with modern pressing methods, such as hot pressing or high-speed pressing, the spatial requirement of the graphite is a factor which massively limits the densities which can be achieved.

The fine graphite powders further tend to segregate as a result of dusting; mixtures containing >0.5% graphite are increasingly difficult to process in this regard. In principle, the use of powders which already have a C content ('prealloyed' or 'master alloy' powders), would be possible, however this solution (which is already successfully applied for the introduction of metal alloy elements) cannot be considered, in the case precision parts, for carbon owing to the greater hardness and therefore poorer pressability of the corresponding powder; carbon stiffens the iron lattice much more strongly than metal alloy additions. The introduction of carbon via admixed carbides has been attempted many times; however the fine and very hard carbides result in unacceptable wear of the dies and such powders also exhibit high susceptibility to segregation.

An iron-carbon master alloy Fe-Y%C with $0.5 \leq Y \leq 6.7$ is known from JP 62063647. This powder is added in an amount of Z% to an iron-based alloy containing A% oxygen, where $Y \times Z \geq 0.75 \times A$. According to the description, a Cr-alloyed iron powder is used for the master alloy. A heat treatment is only carried out after sintering of the alloy.

In accordance with the present invention an iron-carbon master alloy with a C content of between 0.3 and 8 wt % and an upper limit of alloying metals of Ni<10 wt %,
P<4 wt %,
Cr<5 wt %, preferably <1 wt %,
Mn<5 wt %, preferably <1 wt %,
Mo<3 wt %,
W<3 wt %,
Cu<1 wt % is now provided which has a particle size of >20 μm and a hardness of <350 HV 0.01. In accordance with the invention carbon is introduced via a master alloy into the alloy to be formed, said master alloy being similar to the base powder in terms of particle size distribution, but having a high C content, namely up to 8 wt % ('carbon master alloy'). During sintering the carbon diffuses from the particles of this master alloy into the particles of the base powder and is thus distributed homogeneously in the material. Although this master alloy is harder than the base powder, it is much softer than carbide powder, for example. Since only a low percentage of master alloy is mixed with the preferably C-free base powder, the effect on pressability is marginal. The carbon is present in the master alloy as cementite $Fe_3C$, with a density of 7.4 $gcm^{-3}$. With the homogeneous distribution of the C during the sintering process, this density remains virtually unchanged, and above all no additional pores are formed. In other words, the achievable pressing density is only limited by the compressibility of the powder itself (and possibly by the presence of organic lubricants), but not by the volume requirement of the carbon carrier. Since the particles of the master alloy are similar to the base powder in terms of size and shape, the tendency for segregation is minimal and dusting also therefore cannot occur.

The master alloy according to the invention preferably has a C content of between 3 and 8 wt %, particularly preferably a C content of between 4 and 6 wt % and an upper limit of alloying metals Ni<5 wt %,
P<2 wt %,
Cr<0.5 wt %,
Mn<0.5 wt %,
Mo<1.5 wt %,
W<1.5 wt %,
Cu<0.5 wt %.

The upper limits of the alloy metals result from the influences of the different elements and it should be endeavoured to ensure that the master alloy is not too hard so as not to impair the subsequent compression with the base powder.

In accordance with a further embodiment of the present invention, a method for producing an iron-carbon master alloy of this type is provided and comprises the following steps:

- production of a powdered intermediate product which is rich in C,
- possible preliminary annealing of the intermediate product,
- possible deagglomeration of the intermediate product,
- annealing of the powdered intermediate product, which is rich in C, to a temperature of at least 80° C. above the γ-temperature of the phase diagram corresponding to the composition of the intermediate product,
- cooling of the intermediate product at a cooling rate of 3° C./min at most.

The key point in the method according to the invention is the soft annealing of the intermediate product.

The powdered intermediate product, which is rich in C, is preferably produced by atomising a melt of C and Fe or steel. This intermediate product is oxidised over the surface after water atomisation and is cured by rapid cooling; it is therefore preferably soft annealed in a reductive manner in a furnace in the presence of inert gas.

Alternatively, it is possible for the powdered intermediate product, which is rich in C, to be produced by mixing fine Fe or steel powder with C and by a subsequent annealing treatment which dissolves the carbon in the iron powder. As has been demonstrated, relatively high contents of C (up to 8 wt %) can surprisingly be dissolved in the iron matrix.

In accordance with a preferred embodiment of the present invention the annealed intermediate product is cooled at a cooling rate of 3° C/min at most to a temperature of 500° C., after which the cooling rate is increased. The annealed intermediate product is particularly preferably cooled at a cooling rate of 0.5° C/min at most. Owing to the slow cooling, round cementite particles are formed in the microstructure of the master alloy. The object of the heat treatment is to create discrete regions of cementite or bainite which are ineffective, or only slightly effective upon curing, or else coarse discrete regions.

The intermediate product is preferably annealed and cooled in an inert gas atmosphere (reductive or neutral), and this is expedient in particular with surface oxidation of the intermediate product.

The finished master alloy can be processed in accordance with the iron powder metallurgy techniques used, i.e. by mixing with base powder, matrix pressing and sintering; it is not necessary to make any changes to the facilities or the way in which the process is carried out. Even new consolidation methods such as hot pressing, high velocity compaction, etc. are possible without difficulty.

The present invention will now be explained in greater detail with reference to the following examples and comparative tests, although it is not limited to the examples given.

1) Production of Master Alloys:

a) mixing of KIP 4100+5% C→annealing at 1100° C. in $N_2$ for 60 min→master original 1 (comparative mixture according to the prior art)

b) mixing of AstaloyMo (Fe-1.5% Mo, Högänds AB)+5% C→annealing at 1100° C. in $N_2$ for 60 min→master original 2 c) mixing of ASC<45 μm (Fe, ASC100.29 sieve fraction<45 μm, Högänds AB)+5% C→annealing at 1100° C. in $N_2$ for 60 min→master original 3

The 3 masters were deagglomerated and annealed at 900° C., followed by slow furnace cooling. KIP 4100 is a Cr-alloyed iron powder corresponding to the steels used in prior art JP 62063647.

2) C-Measurement

C contents:

master original 1: 4.575%C
master 1 annealed: 4.375%C
master original 2: 4.66%C
master 2 annealed: 4.44%C
master original 3: 4.58%C
master 3 annealed: 4.495%C 3) Microhardness Measurement (HV0.01)

master original 1: 446±139
master 1 annealed: 297±86
master original 2: 352±60
master 2 annealed: 250±63
master original 3: 211±66
master 3 annealed: 111±45

4) Mixing of the Master Alloys with the Corresponding Base Powder to a Target Carbon of 0.55%C a) from: KIP4100+master original 1

KIP4100+master 1 annealed (in accordance with the invention)

KIP4100+0.55%C (graphite UF4, standard material)

Compaction of impact work samples at 200, 400, 600 and 800 MPa, compaction of a tensile sample at 600 MPa, sintering at 1200° C. for 60 min in the presence of N2. Green density, sintered density, proof stress and tensile strength were examined.

| | Compaction pressure [MPa] | Green density [g/cm3] | Sintered density [g/cm3] | Proof stress RP0.2 [MPa] | Tensile strength [MPa] |
|---|---|---|---|---|---|
| KIP + master 1 annealed | 200 | 5.66 | 5.664 | | |
| | 400 | 6.50 | 6.499 | | |
| | 600 | 6.90 | 6.902 | | |
| | 800 | 7.07 | 7.074 | | |
| | 600 MPA tension | 6.85 | 6.848 | 471.1 | 581.1 |
| KIP + master 1 original | 200 | 5.546 | 5.747 | | |
| | 400 | 6.285 | 6.501 | | |
| | 600 | 6.769 | 6.968 | | |
| | 800 | 7.029 | 7.205 | | |
| | 600 MPA tension | 6.289 | 6.990 | 492.5 | 586.2 |
| KIP + 0.55 UF4 | 200 | 5.58 | 6.460 | | |
| | 400 | 6.39 | 6.654 | | |
| | 600 | 6.80 | 7.066 | | |
| | 800 | 7.04 | 7.273 | | |
| | 600 MPA tension | 6.95 | 7.099 | 506.4 | 612.1 |

The green density, and therefore accordingly the compactibility also, behaves as expected, the annealed powder exhibiting significantly greater green densities, however this advantage is cancelled out again by clearly improved sintering with powder which is not annealed, such that practically identical properties are obtained with both variations. The reference sample containing merely admixed carbon (UF4) and without heat treatment, which represents the conventional approach, has lower green densities, but this transitions into considerably greater densities during sintering. It follows that the method according to the invention shows no improvement whatsoever with the Cr-Mn-Mo-alloyed iron powder used in prior art JP 62063647 with the addition of a master alloy with a high carbon content.

b) from: Astaloy Mo+master original 2

Astaloy Mo+master 2 annealed (in accordance with the invention)

Astaloy Mo+0.55%C (graphite UF4, standard material)

Compaction of impact work samples at 200, 400, 600 and 800 MPa, compaction of tensile samples at 600 MPa, sintering at 1200° C. for 60 min in the presence of N2. Green density, sintered density, proof stress and tensile strength were examined.

| | Compaction pressure [MPa] | Green density [g/cm3] | Sintered density [g/cm3] | Proof stress RP0.2 [MPa] | Tensile strength [MPa] |
|---|---|---|---|---|---|
| Astaloy Mo + master 2 annealed | 200 | 5.74 | 5.92 | | |
| | 400 | 6.54 | 6.66 | | |
| | 600 | 6.95 | 7.08 | | |
| | 800 | 7.17 | 7.30 | | |
| | 600 MPA tension | 6.92 | 7.06 | 411.2 | 501.6 |
| Astaloy Mo + master 2 original | 200 | 5.75 | 5.90 | | |
| | 400 | 6.51 | 6.66 | | |
| | 600 | 6.92 | 7.06 | | |
| | 800 | 7.14 | 7.31 | | |
| | 600 MPA tension | 6.89 | 7.02 | 406.5 | 473.6 |
| Astaloy Mo + 0.55 UF4 | 200 | 5.83 | 5.93 | | |
| | 400 | 6.60 | 6.70 | | |
| | 600 | 7.01 | 7.12 | | |
| | 800 | 7.16 | 7.30 | | |
| | 600 MPA tension | 6 .99 | 7.08 | 424.0 | 511.0 |

c) from: ASC<45 μm+master original 3

ASC<45 μm+master 3 annealed (in accordance with the invention)

ASC<45 μm+0.55%C (graphite UF4, standard material)

Compaction of impact work samples at 200, 400, 600 and 800 MPa, compaction of tensile samples at 600 MPa, sintering at 1200° C. for 60 min in the presence of N2. Green density, sintered density, proof stress and tensile strength were examined.

| | Compaction pressure [MPa] | Green density [g/cm3] | Sintered density [g/cm3] | Proof stress RP0.2 [MPa] | Tensile strength [MPa] |
|---|---|---|---|---|---|
| ASC + master 3 annealed | 200 | 5.87 | 6.02 | | |
| | 400 | 6.65 | 6.79 | | |
| | 600 | 7.03 | 7.15 | | |
| | 800 | 7.16 | 7.32 | | |
| | 600 MPA tension | 7.00 | 7.14 | 237.5 | 339.2 |
| ASC + master 3 original | 200 | 5.76 | 5.91 | | |
| | 400 | 6.60 | 6.70 | | |
| | 600 | 6.98 | 7.10 | | |
| | 800 | 7.11 | 7.30 | | |
| | 600 MPA tension | 6.91 | 7.07 | 223.8 | 320.6 |
| ASC + 0.55 UF4 | 200 | 5.93 | 6.03 | | |
| | 400 | 6.85 | 6.83 | | |
| | 600 | 7.06 | 7.21 | | |
| | 800 | 7.18 | 7.35 | | |
| | 600 MPA tension | 7.05 | 7.18 | 233.8 | 340.0 |

The use of the soft annealed master alloy according to the invention results in improved properties compared to master alloys which have not been annealed (master originals). Although the values are slightly lower than with direct admixing of carbon, a considerable drawback of direct admixing, namely segregation, can be prevented, particularly with use on an industrial scale.

5) Mixing of the Master Alloys with the Corresponding Base Powder to a Target Carbon of 0.85%C a) from Fe (ASC 100.29)+18.9% master 3→0.85%C Fe (ASC 100.29)+0.85%C (UF4)→0.85%C b) from Fe-1.5Mo (AstaloyMo)+19.1% master 2→0.85%C Fe-1.5Mo (AstaloyMo)+0.85%C (UF4)→0.85%C Compaction of impact work samples at 600 MPa, compaction of tensile samples at 600 MPa, sintering at 1200° C. for 60 min in the presence of N2. Green density, sintered density, proof stress and tensile strength were examined.

| | Compaction pressure [MPa] | Green density [g/cm3] | Sintered density [g/cm3] | Proof stress RP0.2 [MPa] | Tensile strength [MPa] |
|---|---|---|---|---|---|
| ASC + 18.9% master 3 annealed | 600 | 6.99 | 7.13 | | |
| | 600 MPA tension | 6.94 | 7.12 | 267.0 | 460.4 |
| ASC + 0.85% UF4 | 600 | 7.05 | 7.16 | | |
| | 600 MPA tension | 7.05 | 7.16 | 280.8 | 485.3 |
| AstaloyMo + 19.2% master 2 annealed | 600 | 6.93 | 7.04 | | |
| | 600 MPA tension | 6.90 | 7.05 | 457.2 | 550.0 |
| Astaloy + 0.85% UF4 | 600 | 7.00 | 7.10 | | |

-continued

| | Compaction pressure [MPa] | Green density [g/cm3] | Sintered density [g/cm3] | Proof stress RP0.2 [MPa] | Tensile strength [MPa] |
|---|---|---|---|---|---|
| | 600 MPA tension | 7.01 | 7.09 | 472.2 | 572.7 |

The invention claimed is:

1. An iron-carbon master alloy comprising a C content of between 0.3 and 8 wt% and an upper limit of alloying metals:

Ni<10 wt %;

P<4 wt %;

Cr<5 wt %;

Mn<5 wt %;

Mo<3 wt %;

W<3 wt %;

Cu<1 wt %;

a particle size of >20 μm, and a hardness of <350 HV 0.01.

2. The iron-carbon master alloy of claim 1, further defined as comprising Cr<1 wt %.

3. The iron-carbon master alloy of claim 1, further defined as comprising Mn<1 wt %.

4. The iron-carbon master alloy of claim 1, further defined as comprising a C content of between 3 and 8 wt %.

5. The iron-carbon master alloy of claim 1, comprising a C content of between 4 and 6 wt% and an upper limit of alloying metals:

Ni<5 wt %;

P<2 wt %;

Cr<0.5 wt %;

Mn<0.5 wt %;

Mo<1.5 wt %;

W<1.5 wt %; and

Cu<0.5 wt.

6. A method for producing an iron-carbon master alloy of claim 1 comprising:

producing a powdered intermediate product which is rich in C;

annealing the powdered intermediate product which is rich in C, to a temperature of at least 80 ° C. above the γ-temperature of a phase diagram corresponding to the composition of the intermediate product; and cooling of the intermediate product at at least an initial cooling rate of 3 ° C/min or less.

7. The method of claim 6, wherein the annealed intermediate product is cooled at a cooling rate of 3 ° C/min or less to a temperature of 500 ° C. then increasing the cooling rate.

8. The method of claim 6, further comprising preliminarily annealing the intermediate product.

9. The method of claim 6, further comprising deagglomerating the intermediate product.

10. The method of claim 6, wherein the powdered intermediate product is produced by atomising a melt of C and Fe or steel.

11. The method of claim 6, wherein the powdered intermediate product is produced by mixing fine Fe or steel powder with C and subsequent solution annealing.

12. The method of claim 6, wherein the annealed intermediate product is cooled at an initial cooling rate of 0.5 ° C/min at most.

13. The method of claim 6, wherein the intermediate product is annealed and cooled in an inert gas atmosphere.

* * * * *